United States Patent [19]

Bielefeldt

[11] Patent Number: 4,970,979

[45] Date of Patent: Nov. 20, 1990

[54] SAILING YACHT

[75] Inventor: Ernst-August Bielefeldt, Hollenstedt, Fed. Rep. of Germany

[73] Assignee: Messerschmitt-Boelkow-Blohm GmbH, Munich, Fed. Rep. of Germany

[21] Appl. No.: 391,547

[22] PCT Filed: Dec. 3, 1988

[86] PCT No.: PCT/DE88/00748

§ 371 Date: Jul. 27, 1989

§ 102(e) Date: Jul. 27, 1989

[87] PCT Pub. No.: WO89/05259

PCT Pub. Date: Jun. 15, 1989

[30] Foreign Application Priority Data

Dec. 9, 1987 [DE] Fed. Rep. of Germany ..... 3741758

[51] Int. Cl.[5] ..... B63B 1/28

[52] U.S. Cl. ..... 114/39.1; 114/126; 114/135; 114/136; 114/142; 114/143

[58] Field of Search ..... 114/39.1, 280, 135, 114/136, 137, 142, 143, 126

[56] References Cited

U.S. PATENT DOCUMENTS

| | | | |
|---|---|---|---|
| 2,387,907 | 10/1945 | Hook | 114/280 |
| 2,858,788 | 11/1958 | Lyman | 114/126 |
| 3,179,078 | 4/1965 | Popkin | 114/126 |
| 3,260,232 | 7/1966 | Dougles | 114/126 |
| 3,425,383 | 2/1969 | Scherer . | |
| 3,463,108 | 8/1969 | Neumeier | 114/333 |
| 3,532,067 | 10/1970 | Baker et al. | 114/280 |
| 3,765,356 | 10/1973 | Cook | 114/280 |
| 3,789,789 | 2/1974 | Cleary | 114/39.1 |
| 3,793,973 | 2/1974 | Patterson | 114/39.1 |
| 3,802,366 | 4/1974 | Mankawich | 114/39.1 |
| 4,044,703 | 8/1977 | Kurtz | 114/143 |
| 4,164,909 | 8/1979 | Ballard . | |
| 4,352,335 | 10/1982 | Sugden | 114/143 |

FOREIGN PATENT DOCUMENTS

| | | |
|---|---|---|
| 1343573 | 1/1974 | United Kingdom . |
| 1557539 | 12/1979 | United Kingdom . |

*Primary Examiner*—Sherman Basinger
*Assistant Examiner*—Thomas J. Brahan
*Attorney, Agent, or Firm*—W. G. Fasse; D. H. Kane, Jr.

[57] ABSTRACT

A sailing yacht having a hull and a sectional mast holding a sail, is equipped with a canard rudder and two rolling keels. Each rolling keel has a ballast container. A three point wing system is formed by wings carried by the canard rudder and by the two rolling keels for producing buoyancy, for steering, and for stabilizing. Thus, the three point wing system has a fore wing (9) forming an end wing of the canard rudder and two aft wings (11, 11') forming end wings of the rolling keels (10, 10'). The rolling keels (10, 10') are tiltable about rotational axes extending above the water line approximately in parallel to the hull axis, whereby the rolling keels (10, 10') are normally above the water line and only the long end (14, 14') of the wing (11, 11') dips into the water, so that the end disk wing (15) functions as a lift producing surface. The ballast is shiftable between two ballast containers 17, 17'.

8 Claims, 1 Drawing Sheet

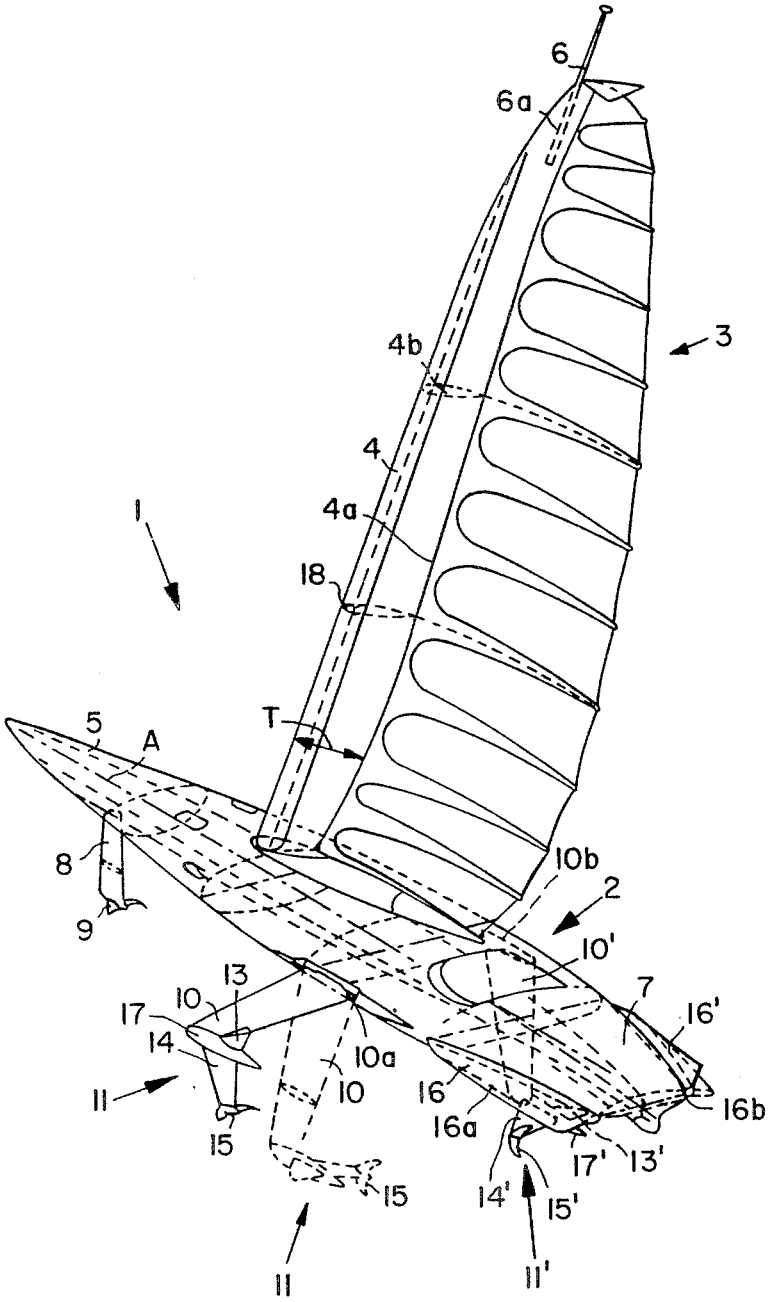
6
6a
3
4b
4
4a
1
18
T
5
A
8
9
10b
2
10'
13
10
17
14
10a
7
16'
11
10
16
16a
16b
15
17'
13'
15
14'
15'
11
11'

SAILING YACHT

FIELD OF THE INVENTION

The invention relates to a sailing yacht with a three point wing system for buoyancy, steering, and stabilizing.

BACKGROUND INFORMATION

Sailing yachts, especially high performance sailing yachts, are constructed advantageously with regard to the utilization of the wind forces, minimizing the water drag and with regard to the steerability and the stabilizing. It is desirable that the respective characteristics of known sailing yachts should be further improved.

OBJECTS OF THE INVENTION

It is an object of the invention to construct a sailing yacht in such a manner, that it exhibits marked improvements regarding the utilization of the wind forces, minimizing the water drag and with regard to the steerability and the stabilizing as compared to conventional solutions.

SUMMARY OF THE INVENTION

The sailing yacht according to the invention comprises a ship's hull and a sail held by a sectional mast, wherein the ship's hull has a canard rudder and two rolling keels. Each rolling keel has a ballast container. The canard rudder and each rolling keel has wings forming a three point wing system for producing buoyancy, for steering, and for stabilizing. The three point wing system is formed substantially by a fore wing and two aft wing pairs. The fore wing is constructed as an end wing of the canard rudder. The aft wing pairs are arranged in a similar manner at the ends of the rolling keels. Each aft wing pair has a long wing member and a short wing member to form said aft wings as pairs of asymmetric wings. The rolling keels are constructed to be tiltable about rotational axes extending approximately parallel to the hull axis. The ballast is displaceable between two ballast containers.

BRIEF DESCRIPTION OF THE DRAWING

The single FIGURE shows a perspectiv view of the present sailing yacht.

DETAILED DESCRIPTION OF A PREFERRED EXAMPLE EMBODIMENT

The FIG. shows perspectively a sailing yacht 1 in a configuration sailing close to the wind, comprising essentially a hull body 2, a sail 3, held by a sectional mast 4 in a manner known as such. A canard rudder 8 is mounted below the bow 5 fore of aft wings 11, 11'. A control wing 9 is located at the lower end of the canard rudder 8. The spinnaker customarily used for sailing before the wind and additional special sails for space wind and half wind courses are not shown here. Rolling keels 10, 10' are secured laterally to the hull body 2 in a tiltable manner about tilting axes **10*a* and 10*b* extending approximately in parallel to the hull axis A. Each rolling keel 10, 10' can be tilted from an approximately vertical position in which it dip's into the water, into an approximately horizontal position in which it is normally above the water and vice versa. A pair 11, 11' of wings is arranged at each of the outer ends of the rolling keels 10, 10' in the manner of end disks. Each wing pair 11, 11' comprises a long wing section 14, 14' arranged to normally reach downwardly from the respective rolling keel 10, 10' and a short wing section 13, 13' arranged to normally reach upwardly from its rolling keel. The short wing section and the long wing section are arranged opposite each other and form an asymmetric wing pair. Each long wing section 14, 14' has a wing end disk 15, 15' at its tip. The wing pairs 11, 11' form together with the control wing 9 a steerable three point lift producing wing system, whereby especially the wing 9 serves for the pitch and longitudinal trim control. When the rolling keels 10, 10'** are in a lateral keel operation position, they produce a controllable hydrodynamic lift. Due to this lift producing effect the friction drag and wave drag on the sailing yacht are reduced in a known manner.

In the drawing the windward rolling keel 10, 10' is shown tilted up in its full line position. In this position the entire rolling keel 10 is located above the water surface, whereby, however, the long wing section 14 dips partially into the water so that now its end disk 15 functions as a hydrodynamic lift and control element. The wing end disks 15, 15' are operatively connected with a position control not shown but known as such, so that by means of the controllably constructed wing end disks 15, 15' a rolling control is achieved. The position control is preferably a closed loop position control system. The above mentioned three point lift producing system 9 11, 11' is preferably controlled by the same closed loop control system.

In this connection it is especially advantageous that by tilting up the rolling keel 10, 10' the hydrodynamic drag of the yacht is reduced. Even if the windward rolling keel 10 is tilted up, the three point lift producing wing system 9, 11, 11' remains effective because the end disks 15 stay in the water, whereby the surfaces of the windward rolling keel are replaced by the respective wing end disk 15.

The rolling keels 10, 10' may comprise a variable curvature known as such for producing lateral lift, whereby the control of the variable curvature elements may take place by a control system preferably a closed loop position control system.

Two ballast containers 17, 17' are arranged at the ends of the rolling keels 10, 10', e.g. one ballast container at each end of the respective rolling keel. The ballast containers may be filled with a liquid suitable for serving as ballast, for example, mercury. The liquid balance may be shiftable between the two ballast containers 17, 17' by means of a pump not shown. It is also possible that an additional shiftable trim ballast in solid or liquid form is used, even coupled with the position closed loop control- and steering system. Solid ballast bodies may be exchangeable one against another.

Two glide flaps 16, 16' are arranged laterally at the stern. The flap 16' on the leeward side may be tilted up during listing headway. During substantially gliding headway the glide flaps 16, 16' contribute to the controlled longitudinal trim, namely the pitching moment control for producing hydrodynamic lift. The glide flaps 16, 16' are tiltable about hinging axes **16*a* and 16*b*** extending approximately in parallel to the longitudinal hull axis A.

The sectional mast 4 is tiltable about an approximately vertical axis which, however, does not coincide with the axis of the mast, but rather extends steeper than the mast axis. Further, the sectional mast 4 is constructed according to the invention in such a manner that its pointed trailing edge 4a has an S-lay or configuration from the bottom up in such a manner that the sectional depth T increases initially and then decreases until the S-configuration is completed. The features of the mast 4 make sure that the sail 3 under the influence of the wind twists itself in such a way that it adapts itself optimally to the wind profile. The mast 4 has a tip 6 that can telescope into a recess 6a in the mast 4. Further, the mast 4 has an aerodynamic cross-section 4b.

For improving the aerodynamic characteristics of the sail 3, the leading edge of the mast 4 is constructed with a leading edge or nose flap 18 known as such. Further, it is possible to arrange in the leading edge zone of the mast 4 respective slats of known construction.

As shown in the Figure, the long wing sections 14, 14' and the short wing sections 13, 13' are secured to opposite sides of the respective ballast container 17, 17'. Thus, these long and short wing sections are arranged in pairs 13, 14 and 13', 14' and each wing pair extends approximately vertically when the respective rolling keel extends approximately horizontally as shown in full lines for the rolling keel 10 in the Figure. Each wing pair also extends approximately horizontally when the respective rolling keel extends approximately vertically as shown by dashed lines in the Figure.

The invention is not limited to the illustrated configuration of the yacht nor the described example embodiment. Rather, the invention encompasses all embodiments and equivalents within the scope of the claims.

I claim:

1. A sailing yacht, comprising a hull with a bow and a stern, a mast mounted on said yacht for holding a sail, canard rudder means secured to said hull near said bow, two rolling keels each hinged to one side of said hull rearwardly of said canard rudder, a first wing means secured as an end wing to said canard rudder, second wing means secured to one rolling keel, third wing means secured to the other rolling keel, said first, second, and third wing means forming a three point wing system for producing buoyancy, for steering, and for stabilizing, said second and third wing means extending approximately perpendicularly from said rolling keels, each of said second and third wing means comprising a long wing section and a short wing section opposite said long wing section, said long wing section extending approximately downwardly when the respective rolling keel is tilted laterally outwardly, each long wing section comprising a wing end disk, said rolling keels being so positioned that in a laterally outwardly tilted position the respective rolling keel is above water and only the corresponding long wing section dips into the water so that the respective wing end disk functions as a lift producing wing surface.

2. The sailing yacht of claim 1, wherein each of said rolling keels comprises a ballast container secured to an end of the respective rolling keel, and wherein said long wing section and said short wing section are secured to the respective ballast container on opposite sides thereof, so that said long and short wing sections extend approximately vertically when a respective rolling keel extends approximately horizontally, and so that said long and short wing sections extend approximately horizontally for producing lift when said respective rolling keel extends approximately vertically.

3. The sailing yacht of claim 1, wherein each rolling keel has a separate hinging axes extending above a water line and approximately in parallel to a longitudinal hull axis for permitting the respective rolling keel to normally extend above water and to dip into the water in a downwardly tilted position of the respective rolling keel.

4. The sailing yacht of claim 1, wherein said mast has a trailing edge with an S-configuration.

5. The sailing yacht of claim 1, wherein said mast has a mast tip adapted for telescoping into said mast.

6. The sailing yacht of claim 1, further comprising gliding flaps arranged laterally at said stern and tiltable about hinging axes extending approximately in parallel to a longitudinal hull axis.

7. The sailing yacht of claim 1, wherein said mast comprises a nose flap.

8. The sailing yacht of claim 1, wherein said mast has an aerodynamic cross-section.

* * * * *